United States Patent [19]

Surko, Jr.

[11] Patent Number: 4,638,651

[45] Date of Patent: Jan. 27, 1987

[54] LOCK CYLINDER HAVING TWO SETS OF TUMBLERS AND KEY THEREFOR

[75] Inventor: Walter E. Surko, Jr., Southington, Conn.

[73] Assignee: Yale Security Inc., Charlotte, N.C.

[21] Appl. No.: 763,205

[22] Filed: Aug. 7, 1985

[51] Int. Cl.[4] ..... E05B 27/02

[52] U.S. Cl. ..... 70/364 A; 70/419

[58] Field of Search ..... 70/364 R, 364 A, 358, 70/419, 421

[56] References Cited

U.S. PATENT DOCUMENTS

| | | | |
|---|---|---|---|
| 3,867,197 | 9/1974 | Lopez | 70/364 A |
| 4,377,082 | 3/1983 | Wolter | 70/364 A |
| 4,434,636 | 3/1984 | Prunbauer | 70/421 |

FOREIGN PATENT DOCUMENTS

| | | | |
|---|---|---|---|
| 73832 | 11/1949 | Denmark | 70/421 |
| 3000869 | 7/1981 | Fed. Rep. of Germany . | |
| 3145064 | 5/1983 | Fed. Rep. of Germany | 70/364 A |

*Primary Examiner*—Robert L. Wolfe

*Attorney, Agent, or Firm*—Dallett Hoopes

[57] ABSTRACT

The usual pin tumbler lock core is provided with an additional set of security disc tumblers adapted to engage contours on the bottom rail of a key and in so doing the security tumblers are rotated as the key is inserted in the lock so that when the key is fully inserted, gates on the security tumblers all align to permit the inward movement of a side bar. The invention also envisions the key which is an otherwise conventional key having a bevelled tip and a security contour on a lateral surface for activation of the security tumblers of the lock of the invention.

15 Claims, 12 Drawing Figures

LOCK CYLINDER HAVING TWO SETS OF TUMBLERS AND KEY THEREFOR

BACKGROUND OF THE INVENTION

1. Field of the Invention

This invention relates to a cylinder lock having two sets of tumblers. More specifically, the invention relates to a lock having the conventional pin tumblers which work on the profile of the upper edge of the key and additional security or disc tumblers which work on a security contour cut on a lateral surface of the key. The invention also relates to a key for such a lock.

2. Description of the Prior Art

The prior art presents a number of cylinder locks having two sets of tumblers. An example is the recent U.S. Pat. No. 4,434,636 which issued Mar. 6, 1984 to Kurt Prunbauer. This patent discloses a cylinder having the conventional set of pin tumblers working along the profile of the edge of the key and a second set of angled pin tumblers located entirely within the cylinder and aimed down at an enlarged rib along the bottom opposite edge of the key, the rib being countoured and the pins designed with recesses adapted to receive a side bar with the result that when the recesses of the auxiliary pin tumblers are aligned, the side bars are permitted to yield inwardly to allow the key to rotate the cylinder core.

The Danish Pat. No. 73,832 which issued in Feb. 15, 1952 discloses a cylinder having a core with a special pin which laterally engages an indentation in the center of the key to manipulate a special auxiliary pin tumblers in addition to the conventional pin tumblers working against the top of the key.

SUMMARY OF THE INVENTION

The present invention is embodied in a lock and a key. The key is conventional but formed with a bevelled tip and along its bottom rib in the preferred embodiment with a security contour having surfaces parallel to the plane of the key. The key also has the conventional top bitting.

The cylinder core of the lock is formed with a slot for the key and also disc-type security tumblers adapted to be partially rotated by engagement with the aforesaid security contour of the key. Gates are formed on the disc tumblers which when aligned allow the inward passage of the fence of a side bar to permit the cylinder core to be turned by the key.

As a result of the structure described a conventional key can be used, one without any odd shape. Further, the lock of the invention is especially well adapted for use in a master key system wherein a lower level of security key may be used to open a cylinder lock without the security tumblers, but only the master key with the security contour opens the locks in accordance with the invention. At the same time the master key of the present invention can operate the lower level lock.

BRIEF DESCRIPTION OF THE DRAWINGS

Further features and objects of the invention will be apparent from the following description and the drawings, all of which disclose a non-limiting embodiment of the invention.

In the drawings.

DETAILED DESCRIPTION OF THE PREFERRED EMBODIMENT

Figure 1A:
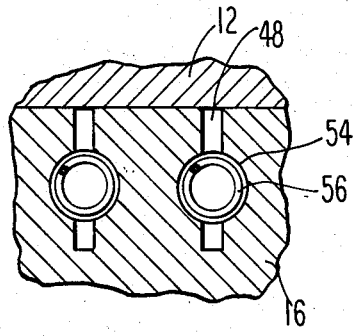
FIG. 1*a* is an enlarged sectional view taken on the line 1*a* of FIG. 1.
Figure 1:
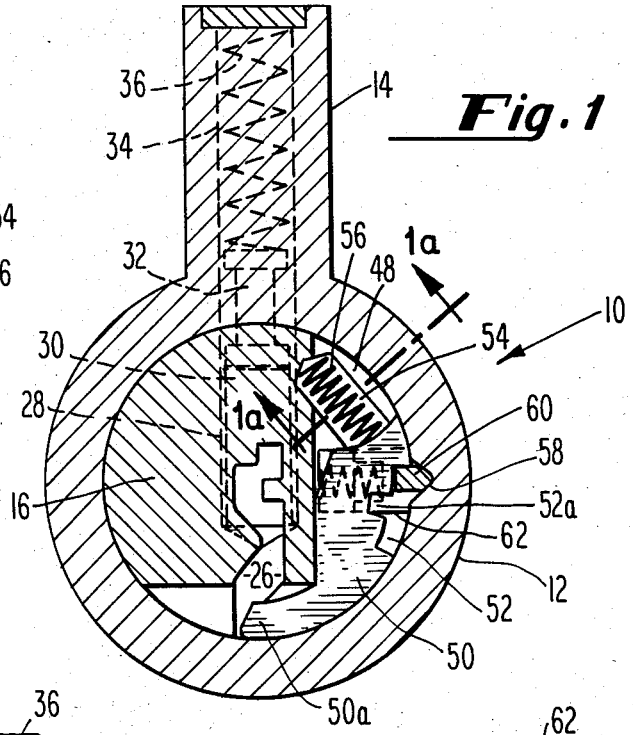
FIG. 1 is a sectional view taken on the line 1—1 of FIG. 2 of a cylinder lock embodying the invention.

A cylinder lock embodying the invention is shown in the sectional view FIG. 1 and generally designated 10. It comprises a cylinder shell 12 having a central opening and a perpendicular tailpiece 14. The shell 12 may take various other well-known shapes such as a mortise lock shell, a rim lock shell, etc. In the cylinder shell is rotatably disposed a cylinder core or plug 16 which is formed on its front end with a circumferential flange 18 (FIG. 2) which rests rotatably inside a hardened steel ring shield 20 disposed in a recess in the front end of the shell 12. Bolted on to the rear end of the core by bolts 22 is the usual operator cam 24, the periphery of which butts against the rear end of the shell 12 and holds the core in the shell.

Formed in the plug is the conventional key slot or keyway 26. Also formed in the plug and intersecting the upper end of the slot are a plurality of aligned vertical tumbler bores 28 which receive pin tumblers 30, the upper ends of which engage the drivers 32, respectively. The drivers 32 disposed in the tailpiece compartments 34 are urged downward, respectively, by a plurality of springs 36. The upper ends of the springs 36 are held down by the plate 38. The upper edge profile of the key works against the pin tumblers to determine the level of the respective meeting lines. Obviously, when the meeting line between each pin tumbler 30 and drivers 32 coincides with the circumference of the cylinder plug 16, the plug, if otherwise free, may be turned.

Figure 2:
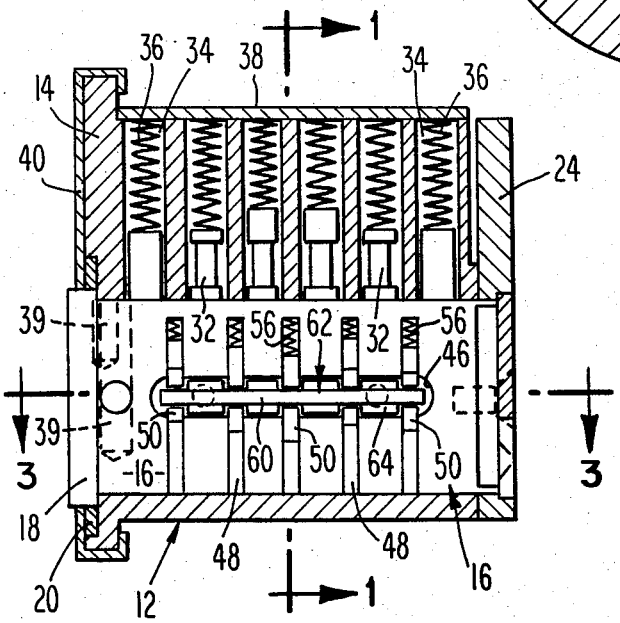
FIG. 2 is a vertical sectional view through the center of the cylinder shell but showing the cylinder core itself in profile.

The plug is bored and filled with conventional hardened steel pins as at 39 (FIG. 2). These, together with the ring shield 20, help to thwart the drilling out of the lock cylinder core. As shown, the front end of the cylinder shell may be covered by a sheath 40 of decorative metal.

Figure 3A:
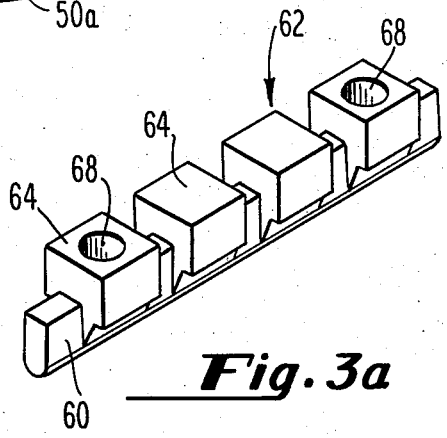
FIG. 3*a* is an enlarged perspective view of the side bar element.
Figure 3:
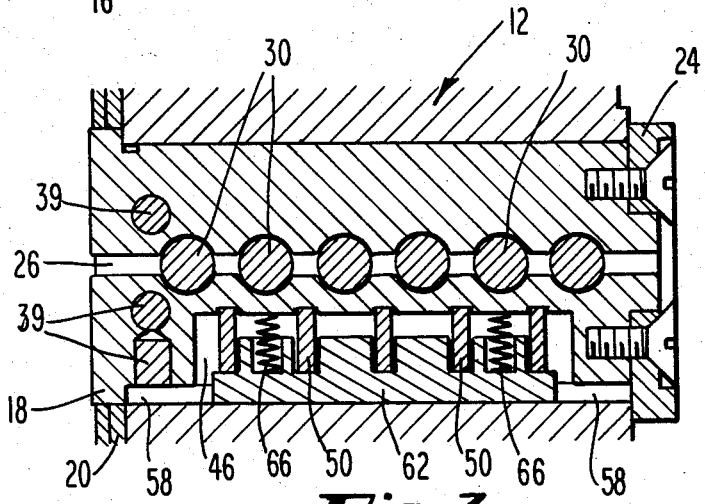
FIG. 3 is an enlarged sectional view taken on the line 3—3 of FIG. 2.

As shown in FIGS. 2 and 3 the side of the plug 16 is formed with a longitudinal recess 46. Preferably in-between the pin tumblers 30, radial slots 48 are formed in the plug. In these slots are respectively disposed a plurality of security disc tumblers 50 which are shaped with an arcuate profile conforming to the curvature of the inside of the shell. The security tumblers are supported by the curved surface of the cylinder opening and the walls of the respective slots 48. In FIG. 1 the security tumblers extend into the bottom of the key slot 26.

The curved outer profile of the security tumblers is interrupted by recesses 52. The recesses 52 each include a central deeper gate 52*a* flanked by shallower sections (preferably at certain levels in the respective security tumblers 50 for reasons which will appear). A bore 54 is shaped in each of the slots 48 to receive a security tumbler biasing spring 56 (FIG. 1) which is bottomed upwardly in the inner end of its bore 54, and urges downward at their lower end against the respective security tumblers 50.

The lower or keyway end 50*a* (FIG. 1) of the security tumblers is chamfered and its inner end presents a contact point X which is engaged by the bevel 82 of the key as will be described below.

Figure 9:
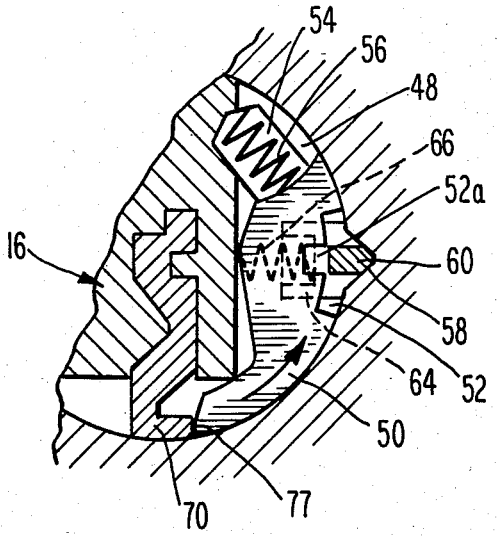
FIG. 9 is an enlarged fragmentary sectional view similar to FIG. 1 but showing the core with the proper key inserted and the disc tumblers aligned.
Figure 10:
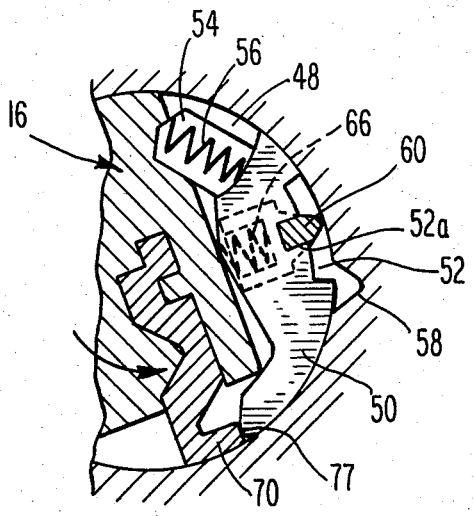
FIG. 10 is a view similar to FIG. 9 but showing the side bar moved inward after the cylinder core has been rotated.

As shown in FIGS. 1, 9, and 10 the central opening of the cylinder shell is formed with a longitudinal groove as at 58 to normally receive the rounded nose of the fence 60 of the steel side bar 62. The opposite side of the side bar is formed with spaced blocks 64 sized to be disposed in-between the security tumblers 50 and serving to guide the side bar in opening 46. Springs 66 are disposed in wells 68, respectively, in the side bar and are bottomed at their inner end against the inner face of the longitudinal recess 46.

Referring now to FIGS. 4 through 8, the key for the lock cylinder of the invention is of generally conventional shape with vitally important exceptions. The key comprises the head 71 and the blade 72, the blade being formed with the conventional longitudinal grooves or splines 74 and the bottom rail 76. Formed in the rail is the security tumbler-engaging contour 77. The contour 77 is ground off parallel to the plane of the key in order that they may be engaged at virtual right angles by the lower tips of the security tumblers 50.

Figure 6:
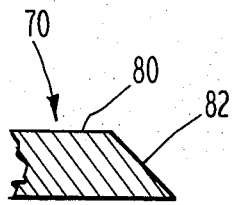
FIG. 6 is a fragmentary sectional view taken on the line 6—6 of FIG. 4.
Figure 7:
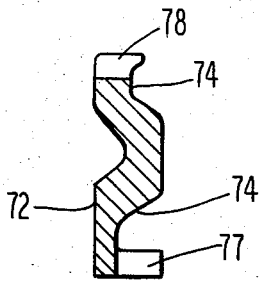
FIG. 7 is an enlarged sectional view taken on the line 7—7 of FIG. 4.
Figure 8:
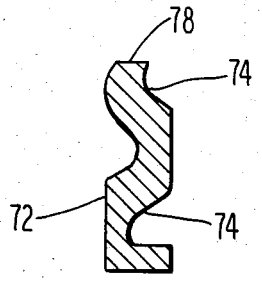
FIG. 8 is an enlarged sectional view taken on the line 8—8 of FIG. 4.

The upper edge 78 of the key has the usual top bittings to cooperate with the pin tumblers 30 in establishing the meeting lines between the pin tumblers and the driver 32, all at the circumference of the plug. Further, the angled lower portion of the nose or tip 80 of the key is sharply bevelled off at 82 at approximately a 45° angle (FIG. 6). As a result there is no need for the security tumblers 50 to be bevelled or cut in a special way to provide for easy movement from their fully rotated position (FIG. 1) as the key enters the keyway.

As the insertion progresses, the security contour 77 cut into the rail 76 permits the security tumblers driven by the springs 56, respectively, to move back in a clockwise direction into the depressions in the contour 77 with the result being that the successful key rotates the security tumblers to a position with their gates 52*a* at a level even with the side bar 62. The full insertion of the successful key with the proper top bitting. of course, also causes the meeting line between the tumbler pins 30 and the driver 32 to be at the level of the core circumference.

Subsequently, as the key and plug are urged to rotate, the fence 60 is cammed inward out of the groove 58 by the shape of the nose of the fence 60 and the shape of the groove as well. It will be understood that when the cylinder is returned by the key to its original position, the fence 60 will have slid outward into the groove 58 to create a detent "feel" to the lock telling the operator that the lock is in the key-withdrawal position. The subsequent removal of the key will permit the security tumblers 50 to move clockwise to the position shown in FIG. 1. Additionally, the tumbler pins 32, no longer raised by the top bitting 78 of the key, will drop down as the key is removed and the drivers 32 will block the rotation of the core.

It should be noted that the mechanism of the high security lock of the invention is all within the cylinder core so that if there is a malfunction and the mechanism need be replaced the replacement of the core is a simple operation.

A further advantage of having the mechanism within the cylinder core is that it does not require additional projections from the cylinder shell which could interfere with the use of the shell with standard locks.

Obviously, the insertion of the wrong key in the slot results in either the meeting lines between the pin tumbler 30 and the drivers 32 not being at the circumference of the plug and/or the gates 52*a* not being aligned at the proper level to permit inward movement of the side bar 62.

To permit the inward movement of the side bar 62, it will be seen that under the present invention there has been made possible a key and lock cylinder of a high level of security in that not only the conventional top bitting 78 must be successful, but also the security contour 77 must also be successful to rotate the security tumblers to the proper position, respectively. From another aspect the present lock would be extremely difficult to pick. Not only would the perpetrator have to raise each of the top tumbler pins to the proper level, he would also have to push aside the security tumblers to the proper position and in addition, insert a torque tool to turn the core. This is simply beyond the capabilities of the most experienced perpetrator.

Figure 4:
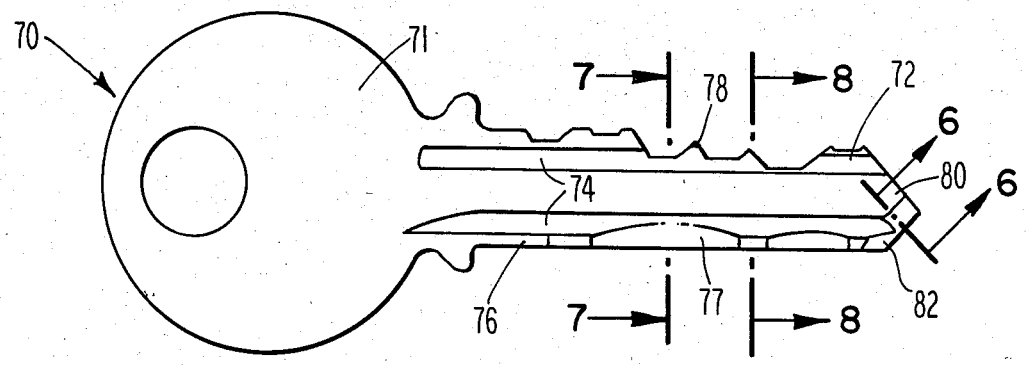
FIG. 4 is an enlarged side elevational view of the key embodying the invention.
Figure 5:
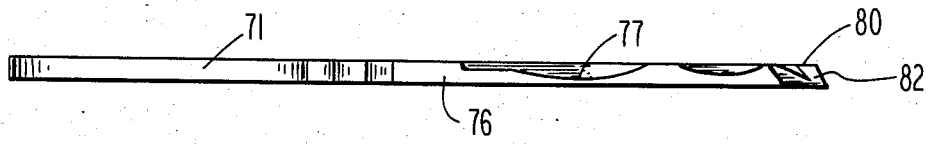
FIG. 5 is a bottom plan view.

Another advantage of the present lock is that the key is, aside from the security contour 77, entirely conventional and can be used with the properly set similar lock without the security tumblers 50 so that in a master key system, the master key of FIGS. 4 and 5 can open the similar sub-master locks and the lock of the invention, while the sub-master keys without the contour 77 can only open the sub-master locks.

Thus, the invention offers a practical high security lock and key which are conventional in appearance and are readily adapted to a master key system.

While the embodiments of the invention have been disclosed in a single form, it is not so limited, but is susceptible of many changes all coming within the scope of the following claim language which defines the invention.

I claim:

1. In combination, a key having front and back surfaces and comprising a head and a blade, the blade having on its front surface along one longitudinal edge conventional edge bittings and along the opposite edge a side rail, the side rail having a contoured edge code, the edge code extending a substantial part of the length of the blade including a series of bittings defined by lines transverse of the blade and substantially parallel to the plane of the key, the blade having at its end farthest from the head a nose portion including an incline plane on the side rail tapering down from the front of the blade to meet the back of the blade in a fine edge; and lock cylinder receiving the key and comprising a housing having a cylindrical opening, a lock core in the cylindrical opening and formed with a keyway including a portion receiving the side rail, the core and the housing being provided with the conventional pin tumblers and pin tumbler openings above the keyway, the pin tumblers engaging the top edge bittings on the key, the core also formed with transverse slots intersecting the keyway, partial disc tumblers disposed in the respective slots, spring means urging the disc tumblers to a position with their ends disposed in the keyway, the disc tumblers being formed with gates on their outer periphery at selected points respectively, a side bar normally disposed partly in a recess in the core and also partly in a longitudinal groove in the housing at one side of the cylindrical opening, the groove having sloping walls, means urging the side bar outward, the side bar being cammed inward of the housing when the core is turned, such turning being made possible only provided the key is inserted in the keyway, said fine edge serving to wedge under the ends of the partial disc tumblers in insertion to move them, and the contoured edge code engaging the ends of the disc tumblers to position the disc tumblers with their gates in alignment with the side bar and thereby permitting the side bar to move inward totally into the recess in the core.

2. A lock cylinder as claimed in claim 1 wherein the blade is pointed and the nose portion of the incline plane is angled so that its intersection with the back surface of the key comprises an angled line comprising a side of the point.

3. A lock cylinder as claimed in claim 1 wherein the blade includes a series of bittings along its top edge.

4. A lock cylinder comprising a housing having a cylindrical opening, a lock core in the cylindrical opening and formed with a keyway including a portion for a side rail along the bottom edge of the blade of a key, the core and the housing being provided with the conventional pin tumblers and pin tumbler openings above the keyway and adapted to engage the conventional top edge bittings on a conventional key, the core also formed with transverse slots intersecting the keyway, partial disc tumblers disposed in the respective slots and having ends disposed in the keyway portion, first spring means urging the disc tumblers into the keyway portion, the disc tumblers being formed with gates on their outer periphery at selected points respectively, a side bar normally disposed partly in a recess in the core and also partly in a longitudinal groove in the housing at one side of the cylindrical opening, the groove having sloping walls, second spring means in the core urging the side bar outward, the side bar being cammed inward of the housing when the core is turned provided the proper key is in the keyway and special contour on the side rail of the key engages the ends of the disc tumblers to position the disc tumblers with their gates in alignment with the side bar and thereby permit the side bar to move inward totally into the recess in the core.

5. A lock cylinder as claimed in claim 4 wherein the slots are spaced intermediate the pin tumblers, respectively.

6. A lock cylinder as claimed in claim 4 wherein the side bar is formed with a plurality of spaced blocks on its side inward from the housing and the blocks engage the sidewalls of the recess to guide the side bar as it moves inward.

7. A lock cylinder as claimed in claim 6 wherein a pair of spaced blocks are formed with wells respectively facing inward of the core and the second spring means are disposed in the wells and bottom in the inward wall of the recess.

8. A lock cylinder as claimed in claim 4 wherein the spring means urging the disc tumblers into the key slot are housed in bores, respectively, in the core in enlargements of the slot means.

9. A lock cylinder as claimed in claim 4 wherein the partial disc tumblers are supported by the walls of the cylindrical opening in the housing and the transverse slots in the core and capable of rotation about the axis of the cylindrical opening in the housing.

10. In combination a high security lock cylinder comprising a lock housing and rotatable core with keyway in the housing, the housing having a side bar groove therein, a side bar adapted to normally reside in the side bar groove, first spring means in the core urging the side bar outward, the core having a plurality of partial security disc tumblers having gate means at various levels respectively adapted to pass the side bar inward and having ends at the periphery of the core which in their first position extend into the keyway, second spring means urging the partial disc tumblers toward their first position, and a key having conventional shape but having lateral contours along an edge opposite the usual top edge bitting and which when the key is all the way in the keyway, hold the disc tumblers with their gates aligned at the level of the side bar, and the cylinder and core also having the usual pin tumblers engaging the edge bitting.

11. A lock cylinder as claimed in claim 10 wherein the disc tumblers are disposed alternatively with the pin tumblers along the length of the cylinder.

12. A lock cylinder as claimed in claim 11 wherein the disc tumblers are biased with the said ends extending into the keyway by axial springs disposed in bores which are lateral enlargements of slots which hold the disc tumblers in place.

13. A lock cylinder comprising a housing having a cylindrical opening, a lock core in the cylindrical opening formed with a keyway including a portion for a side rail along the bottom edge of the blade of a key, the core also formed with transverse slots intersecting the keyway, partial disc tumblers disposed in the respective slots and having ends disposed in the keyway portion and supported by the walls of the cylindrical opening in the housing and the walls of the transverse slots in the core, the partial disc tumblers being capable of limited rotation about the axis of the cylindrical opening in the housing as the core remains stationary, first spring means urging the partial disc tumblers into the keyway portion, the partial disc tumblers being formed with gates on their outer periphery at selected points respectively, a side bar normally disposed partly in a recess in the core and also partly in a longitudinal groove in the housing at one side of the cylidrical opening, the groove having sloping walls, second spring means in the core urging the side bar outward, the side bar being cammed inward of the housing when the core is turned provided the proper key is in the keyway and a special contour on the side rail of the key engages the ends of the disc tumblers to position the disc tumblers with their gates in alignment with the side bar and thereby permit the side bar to move inward totally into the recess in the core.

14. A lock cylinder as claimed in claim 13 wherein the ends of the partial disc tumblers which extend into the keyway portion are pointed at their bottom end and taper upwardly in a direction away from the wall of the opening to provide a contact point spaced inward of the cylinder from the point of the disc tumbler, and the key is pointed and has a beveled surface which upon insertion first engages the said end of the disc tumblers at said contact points, whereby the said end of the partial disc tumblers can bottom on the remote wall of the keyway and the beveled surface of the key can engage the contact point to rotate the partial disc tumbler.

15. A lock cylinder comprising a housing having a cylindrical opening, a lock core in the cylindrical opening and formed with a keyway including a portion for a side rail along the bottom edge of the blade of a key, the core and the housing being provided with the conventional pin tumblers and pin tumbler openings above the keyway and adapted to engage the conventional top edge bittings on a conventional key, the cylinder also formed with transverse slots intersecting the keyway, partial disc tumblers disposed in the respective slots and having ends disposed in the keyway portion, first spring means urging the disc tumblers into the keyway portion, the disc tumblers being formed with gates on their outer periphery at selected points respectively, a side bar normally disposed partly in a recess in the core and also partly in a longitudinal groove in the housing at one side of the cylindrical opening, second spring means for urging the side bar outward into the groove to block rotation of the core and allow the partial disc tumblers to rotate, cam means on the margins of the groove to force the side bar inward when the proper key is in the keyway and turned, the proper key having special contour on its side rail to engage on insertion the ends of the disc tumblers to move them so that their gates are in alignment with the side bar and thereby permit the side bar to move inward totally into the recess of the core, and the second spring means comprises at least a pair of spaced axial springs disposed in compression between the core and the side bar.

* * * * *